United States Patent [19]

Johnson

[11] 4,337,417

[45] Jun. 29, 1982

[54] STARTING AND OPERATING APPARATUS FOR HIGH-PRESSURE SODIUM LAMPS

[75] Inventor: James C. Johnson, Vicksburg, Miss.

[73] Assignee: Westinghouse Electric Corp., Pittsburgh, Pa.

[21] Appl. No.: 178,046

[22] Filed: Aug. 14, 1980

[51] Int. Cl.[3] ..... H05B 37/00

[52] U.S. Cl. ..... 315/290; 315/DIG. 7; 315/209 SC

[58] Field of Search ..... 315/290, 209 SC, 101, 315/DIG. 7

[56] References Cited

U.S. PATENT DOCUMENTS

| | | | |
|---|---|---|---|
| 3,917,976 | 11/1975 | Nucholls | 315/258 |
| 3,963,958 | 6/1976 | Nucholls | 315/276 |
| 4,072,878 | 2/1978 | Engel et al. | 315/205 |
| 4,143,304 | 3/1979 | Hitchcock | 315/258 |
| 4,210,850 | 7/1980 | Britton | 315/290 |

*Primary Examiner*—Harold A. Dixon
*Attorney, Agent, or Firm*—R. S. Lombard

[57] ABSTRACT

A lighting apparatus which provides for high-voltage pulses for starting a high-pressure sodium discharge lamp and thereafter provides operating ballasting. The apparatus uses two capacitors and associated blocking diodes and a charging resistor. One of the capacitors charges toward the peak of the line voltage in the negative half cycle, and thereafter, when the line voltage goes positive, the voltage on the one capacitor is added to the line voltage for charging the other capacitor. When the voltage on the other capacitor reaches a predetermined voltage exceeding the Zener voltage of a paralleling Zener diode which Zener voltage may be about twice the peak voltage of the line, the other capacitor discharges through a ballast inductor which is connected in autotransformer relationship therewith to provide a high voltage pulse of sufficient magnitude to start the lamp.

1 Claim, 1 Drawing Figure

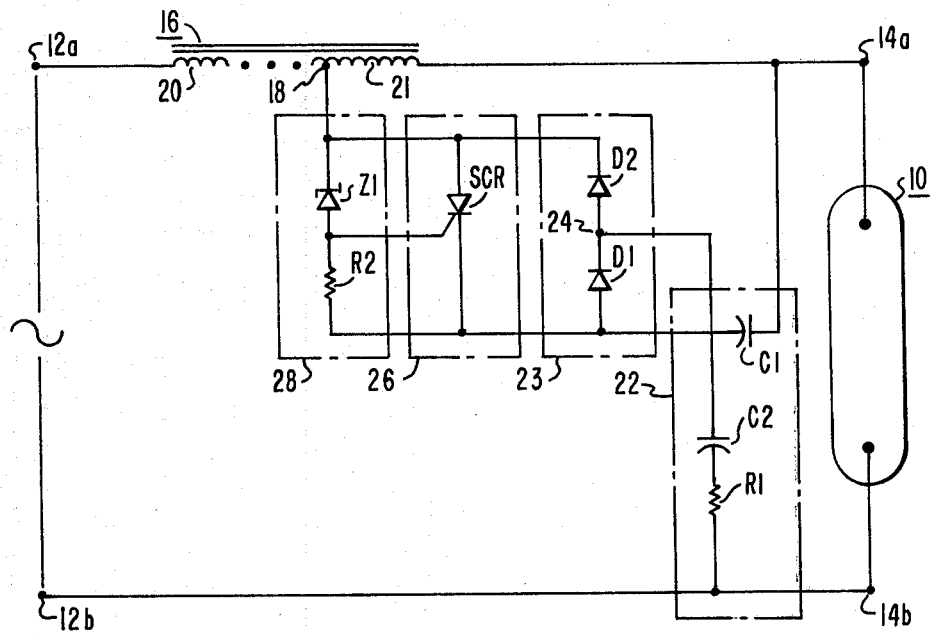
16
12a
14a
20
18
21
Z1
SCR
D2
10
24
R2
D1
C1
28
26
23
22
C2
R1
12b
14b

STARTING AND OPERATING APPARATUS FOR HIGH-PRESSURE SODIUM LAMPS

CROSS-REFERENCE TO RELATED APPLICATIONS

In co-pending application Ser. No. 161,541, filed Aug. 14, 1980 is disclosed a starting and operating apparatus for high-pressure sodium lamps which uses a single capacitor in series with a blocking diode and a charging resistor to provide high-voltage pulses for starting a high-pressure sodium discharge lamp and thereafter provides operating ballasting.

BACKGROUND OF THE INVENTION

This invention relates to apparatus for starting and then operating high-pressure sodium discharge lamps and, more particularly, to such apparatus which provides high-voltage pulses for initiating the discharge in such lamps.

A number of high-pressure sodium discharge lamp lighting circuits have been developed in recent years such as that disclosed in U.S. Pat. No. 4,072,878, issued Feb. 7, 1978, to Engel et al. The Engel patent discloses an apparatus that provides for high-voltage pulses for starting a sodium discharge lamp by using the breakdown characteristics of a Zener diode to provide accurately timed starting pulses. The use of the Zener diode eliminates timing problems encountered when the breakdown characteristics of a glow lamp are used in somewhat similar fashion, as described in U.S. Pat. No. 3,917,976, issued Nov. 4, 1975, to Nuckolls, and U.S. Pat. No. 3,963,958, issued June 5, 1976, to Nuckolls.

Another apparatus for starting and operating a high-pressure sodium lamp is disclosed in U.S. Pat. No. 4,143,304, issued Mar. 6, 1979, to Hitchcock et al. The Hitchcock apparatus uses a voltage amplification circuit, utilizing two individual capacitors, the output of which is applied across the ballast reactor which is connected to the reactor in autotransformer relationship. This circuit provides a sufficiently high-voltage starting pulse, even when ballast reactors of low open circuit voltage are used to initiate the operation of high-pressure sodium discharge lamps.

SUMMARY OF THE INVENTION

There is provided a relatively simple and very efficient starting and operating apparatus for connection across an AC source for starting and then operating a high-pressure sodium discharge lamp.

The apparatus comprises input terminals operable to be connected across the AC source and output terminals operable to have a discharge lamp connected thereacross. A ballast inductor has a tap intermediate the ends thereof to define first and second winding portions. The first winding portion has a greater length than the second winding portion and has a transformation ratio therebetween substantially greater than unity. The ballast inductor is connected at its ends in series between one of the input terminals and one of the output terminals with the second winding portion connected to the one output terminal. The other of the input terminals is electrically connected to the other of the output terminals.

The apparatus also comprises capacitive energy storage means and blocking diode means therefor connected in circuit between the output terminals and also in circuit with the tap. The capacitive energy storage means comprises two individual capacitors, and the blocking diode means comprises two blocking diodes. One of the capacitors is connected in circuit between the one output terminal and the anode of one of the blocking diodes. The cathode of the one blocking diode is connected in circuit to a common electrical point. The other of the capacitors is connected in circuit between the common electrical point and the other output terminal. The other of the blocking diodes has its anode connected in circuit with the common electrical point and its cathode connected in circuit with the tap.

The apparatus further includes gate-controlled solid-state switching means comprising an SCR having its anode connected in circuit with the tap and its cathode connected in circuit with the anode of the one blocking diode.

The apparatus further includes Zener diode means comprising a Zener diode having its cathode connected in circuit with the tap and its anode connected in circuit with the gate of the SCR. The Zener diode has a predetermined Zener voltage which is less than twice the peak voltage of the source. The Zener diode means further comprises a bleeder resistor connected in circuit between the gate and the cathode of the SCR, whereby when the apparatus is initially energized, the second capacitor charges toward the peak voltage of the AC source during the negative half cycle and when the source goes positive, the voltage on the second capacitor is added to the voltage of the source to charge the first capacitor towards twice the peak of the source. Upon the voltage of the first capacitor exceeding the predetermined Zener voltage of the Zener diode, the SCR is gated thereby causing the first capacitor to discharge through the second winding portion to cause the autotransformer action thereof to apply a voltage pulse of sufficient magnitude across the output terminals to start the lamp connected thereacross, and after the lamp is started, the Zener voltage of the Zener diode is not exceeded, thereby rendering the lamp starting portion of the apparatus inoperative.

BRIEF DESCRIPTION OF THE DRAWING

For a better understanding of the invention, reference may be had to the preferred embodiment, exemplary of the invention, shown in the accompanying drawing in which the sole FIGURE is a circuit diagram of the preferred embodiment of the present invention.

DESCRIPTION OF THE PREFERRED EMBODIMENT

In the sole FIGURE is shown a starting and operating apparatus for connection across an AC source for starting and then operating a high-pressure sodium discharge lamp 10. The apparatus comprises input terminals 12*a*, 12*b* operable to be connected across an AC source and output terminals 14*a*, 14*b* operable to have the discharge lamp 10 connected thereacross. A ballast inductor 16 has a tap 18 intermediate the ends thereof to define a first winding portion 20 and a second winding portion 21. The first winding portion 20 has a greater length than the second winding portion 21, with the first and second winding portions having a transformation ratio therebetween substantially greater than unity. In the specific example as given, the first winding 20 has 240 turns and the second winding 21 has 12 turns. The ballast inductor 16 is connected at its ends in series between one of the input terminals 12*a* and one of the output terminals 14*a* with the second winding portion 21 connected to the output terminal 14*a*. The other of the input terminals 12*b* is electrically connected to the other of the output terminals 14*b*.

Capacitive energy storage means 22 and blocking diode means 23 therefor are connected in circuit between the output terminals 14*a*, 14*b* and also in circuit with the tap 18. The capacitive energy storage means 22 comprises two individual capacitors C1, C2, and the blocking diode means 23 comprises two blocking diodes D1, D2. One of the capacitors C1 is connected in circuit between the one output terminal 14*a* and the anode of one of the blocking diodes D1. The cathode of diode D1 is connected in circuit to a common electrical point 24. The other of the capacitors C2 is connected in circuit between the common electrical point 24 and the other output terminal 14*b*. A charging resistor R1 is connected in series circuit with the capacitor C2 between the common electrical point 24 and the other output terminal 14*b*. The other blocking diode D2 has its anode connected in circuit with the common electrical point 24 and its cathode connected in circuit with the tap 18.

A gate-controlled solid-state switching means 26 comprises an SCR having its anode connected in circuit with the tap 18 and its cathode connected in circuit with the anode of the one blocking diode D1.

A Zener diode means 28 comprises a Zener diode Z1. Zener diode Z1 has its cathode connected in circuit with a tap 18 and its anode connected in circuit with the gate 30 of the SCR. The Zener diode has a predetermined Zener voltage which is less than twice the peak voltage of the AC source. The Zener diode Z1 further comprises a bleeder resistor R2 connected in circuit between the gate and the cathode of the SCR. The bleeder resistor R2 serves to prevent premature gating of the SCR.

In the operation of the foregoing apparatus, when it is initially energized, the capacitor C2 charges toward the peak voltage of the AC source during the negative half cycle, through the charging resistor R1. When the voltage of the source goes positive, the voltage on capacitor C2 is added to the voltage of the source to charge capacitor C1 toward twice the peak of the source. Upon the voltage of the capacitor C1 exceeding the predetermined Zener voltage of the Zener diode Z1, the SCR is gated which causes the capacitor C1 to discharge through the second winding portion 21 to cause the autotransformer action thereof to apply a voltage pulse of sufficient magnitude, such as 3,000 volts, across the output terminals 14*a*, 14*b* to start the lamp 10 connected thereacross. After the lamp is started, the Zener voltage of the Zener diode Z1 is not exceeded, which renders the lamp starting portion of the apparatus inoperative. The following tables set forth component values for the circuit shown in the sole FIGURE. The Table gives component values for 120 volt operation.

TABLE

| | | | |
|---|---|---|---|
| R1 | 6,200 Ohms | 2 Watt | 5% |
| R2 | 1,000 Ohms | ½ Watt | 10% |
| C1 | 0.15 Mfd. | 250 VDC | 10% |
| C2 | 0.33 Mfd. | 250 VDC | 10% |
| D1,D2 | IN4005 | (600V, 1 Amp) | |
| Z1 | IN987 | (120V, 2 in series) | |
| SCR | T-106D1 | (400V, 4 Amp) | |
| Lamp 10 | 55 Volt (S55) | 150 Watt, high-pressure sodium | |

Utilizing the present apparatus, advantage is taken of the relationship $E=\frac{1}{2}CV^2$, where E is energy, C is capacitance and V is voltage. In the circuit as shown, by charging C1 towards twice the peak of the line voltage through charging resistor R1, advantage is taken of the "$V^2$" portion of the foregoing equation so that a maximum amount of charge energy is used to provide the pulse. Another advantage of this circuit is that although during the charging of C1 the effective capacitance of C1 and C2 is less than the smaller of C1 and C2; during discharge of C1, capacitor C1 is the only capacitor in the discharge path. Thus, this circuit takes maximum advantage of the foregoing relationship compared to other prior art circuits. For the component values shown in the Table, utilizing the foregoing equation, the energy developed by this circuit is equal to about $4.3\times10^{-3}$ joules. In addition, utilizing the blocking diode means 23, the energy dissipated in the charging resistor R1 during operation is relatively low since the capacitor charges only once after the lamp is in operation, and therefore, little current will flow through the charging resistor R1, thereby significantly lowering the power dissipation in the resistor. The diode D2 permits the use of a relatively low voltage rating for the SCR since D2 blocks reverse voltage and the Zener diode D1 governs the turn-on in the forward direction.

I claim:

1. A starting and operating apparatus for connection across an AC source for starting and then operating a high-pressure sodium discharge lamp, said apparatus comprising:

(a) input terminals operable to be connected across said AC source, output terminals operable to have said discharge lamp connected thereacross, a ballast inductor having a tap intermediate the ends thereof to define first and second winding portions, said first winding portion having a greater length than said second winding portion and having a transformation ratio therebetween substantially greater than unity, said ballast inductor connected at its ends in series between one of said input terminals and one of said output terminals with said second winding portion connected to said one output terminal, and the other of said input terminals electrically connected to the other of said output terminals;

(b) capacitive energy storage means and blocking diode means therefor connected in circuit between said output terminals and in circuit with said tap, said capacitive energy storage means comprising two individual capacitors, and said blocking diode means comprising two blocking diodes, one of said capacitors connected in circuit between said one output terminal and the anode of one of said blocking diodes, the cathode of said one diode connected in circuit to a common electrical point, the other of said capacitors connected in circuit between said common electrical point and said other output terminal, a charging resistor connected in series circuit with said other capacitor between said common electrical point and said other output terminal, the other of said blocking diodes having its anode connected in circuit with said common electrical point and its cathode connected in circuit with said tap;

(c) gate-controlled solid-state switching means comprising an SCR having its anode connected in circuit with said tap and its cathode connected in circuit with the anode of said one blocking diode;

(d) Zener diode means comprising a Zener diode having its cathode connected in circuit with said tap and its anode connected in circuit with the gate of said SCR, said Zener diode having a predetermined Zener voltage which is less than twice the peak voltage of said source, said Zener diode means further comprising a bleeder resistor connected in circuit between the gate and the cathode of said SCR, whereby when said apparatus is initially energized, said other capacitor charges toward the peak voltage of said AC source during the negative half cycle and when the voltage of said source goes positive, the voltage on said other capacitor is added to the voltage of said source to charge said one capacitor toward twice the peak of said source, upon the voltage of said one capacitor exceeding said predetermined Zener voltage of said Zener diode, said SCR is gated thereby causing said one capacitor to discharge through said second winding portion to cause the autotransformer action thereof to apply a voltage pulse of sufficient magnitude across said output terminals to start said lamp connected thereacross, and after said lamp is started, the Zener voltage of said Zener diode is not exceeded, thereby rendering the lamp starting portion of said apparatus inoperative.

* * * * *